United States Patent [19]

Karlovitz

[11] 4,146,389

[45] Mar. 27, 1979

[54] THERMAL REDUCTION PROCESS OF ALUMINIUM

[75] Inventor: Bela Karlovitz, Pittsburgh, Pa.

[73] Assignees: Bela Karlovitz; Bernard Lewis, both of Pittsburgh, Pa.

[21] Appl. No.: 843,275

[22] Filed: Oct. 18, 1977

[51] Int. Cl.[2] ..... C22D 7/02

[52] U.S. Cl. ..... 75/10 R; 75/68 R

[58] Field of Search ..... 75/10 R, 11, 68 R, 68 A

[56] References Cited

U.S. PATENT DOCUMENTS

| | | | |
|---|---|---|---|
| 3,232,746 | 2/1966 | Karlovitz | 75/10 R |
| 3,390,979 | 7/1968 | Greene | 75/11 |
| 3,607,221 | 9/1971 | Kibby | 75/10 R |
| 3,765,870 | 10/1973 | Fey et al. | 75/10 R |
| 3,843,351 | 10/1974 | Smith et al. | 75/10 R |
| 3,893,845 | 7/1975 | Mahaffey et al. | 75/10 R |

*Primary Examiner*—M. J. Andrews

*Attorney, Agent, or Firm*—Webb, Burden, Robinson & Webb

[57] ABSTRACT

The thermal reduction process for producing metals such as aluminum in a reactor utilizes a dispersed discharge to provide the heat of reaction within the reaction zone in the presence of aluminum vapor to maintain the temperature in excess of 2000° C. The aluminum oxide powder and a reductant in a gaseous medium are introduced with a tangential component into the reactor to create a vortex motion. A minimum turbulence level within the reactor in the reaction zone is maintained so as to keep the solid particles in suspension and prevent the dispersed discharge from forming electrical arcs. Aluminum oxide is reduced to aluminum vapor which is removed with the effluent stream of gases from the reaction zone. Thereafter, the effluent is rapidly passed through a condenser where the temperature is dropped to liquefy the aluminum vapor which is then discharged in a continuous stream. The effluent stream is monitored for unreacted carbon or aluminum oxide and this information is fed back to the reactor for controlling the input of the starting materials.

19 Claims, 3 Drawing Figures

THERMAL REDUCTION PROCESS OF ALUMINIUM

FIELD OF THE INVENTION

My invention relates to a process for the production of metals and, more particularly, to a thermal reduction process employing a dispersed electrical discharge for heating a reaction zone in the production of metals such as aluminum from their oxides.

DESCRIPTION OF THE PRIOR ART

The traditional method of producing aluminum (Hall Process) is by the electrolysis of aluminum oxide dissolved in molten cryolite. This normally takes place in a large number of electrolytic cells connected in series. Consumable annodes of carbon connected as the positive pole of the cell extend close to the molten metal surface. Heat is developed by the electrical resistance of the bath as low voltage-high direct current electricity is passed therethrough. Each cell requires separate servicing for feeding the cell and for renewal of the annode. In addition, the molten metal must be removed from each cell separately. The cells are open, therefore, creating air pollution problems.

Newly developed methods of producing aluminum include reducing aluminum oxide by carbon to aluminum trichloride in a reactor. Thereafter, aluminum is produced from the aluminum trichloride in a completely enclosed electrolytic cell.

Processes have also been developed which utilize charging finely divided ore into a reaction zone. However, such systems use either electric resistance heating or an electric arc to generate the necessary temperatures. Representative of these processes are U.S. Pat. Nos. 3,365,185; 3,563,726 and 3,765,870, with the latter patent being directed to the reduction of metal oxides other than aluminum.

SUMMARY OF THE INVENTION

My process for reducing certain metal oxides such as aluminum oxide is completely closed, thereby eliminating the pollution problems associated with open cells. In contrast to an arc, my dispersed discharge system uses high voltage and correspondingly much smaller currents than an arc of the same power input. Standard three-phase a.c. current can be used, thereby saving the cost of conversion to d.c. power. The dimensions of the electrodes are much smaller than those of an arc system and the electrode consumption is minimal. The feed materials are easily introduced into the high temperature zone and the length of the gap between the electrodes is not critical in my process.

I provide a long residence time for the reactants, thereby assuring that the oxide is retained until consumed by the reaction and converted into aluminum vapor. As a result, I have combined the functions of a centrifugal separator with a reduction process thereby assuring a high efficiency of operation. The purity of the metal is very high because no impurities are introduced with the reducing agent and the liquid metal is obtained by condensation.

I further provide a feedback control system by monitoring the radiation emitted by the effluent stream. This feedback control ties in with the flow rate of the reactants or an oxygen input into the reactor thereby assuring the purity of the product. By maintaining high temperatures in the area of the discharge through the dispersed discharge mode of heating, I am able to eliminate aluminum carbide and other undesirable by-products from the effluent stream.

My thermal reduction process for reducing aluminum in a reactor consists of establishing a dispersed discharge within the high temperature reaction zone in the presence of aluminum vapor. Aluminum oxide powder and a reductant such as natural gas or solid carbon in a gaseous medium is introduced into the reaction zone with a tangential component so as to create a vortex motion. This vortex motion is maintained above a minimum turbulence level so as to keep the solid particles in suspension and maintain the dispersed discharge. Aluminum oxide powder is reduced to aluminum vapor which is removed from the reaction zone with the effluent stream. Thereafter, the aluminum vapor is condensed into a continuous liquid stream.

THERMAL REDUCTION PROCESS FOR THE PRODUCTION OF ALUMINUM

The thermal reduction process described herein utilizes the dispersed electrical discharge for heating the reduction furnace. In contrast to an electric arc, high power input into a distributed discharge is maintained at conveniently high voltages (about 3000 to 5000 volts) and moderate current levels. The example described below utilizes natural gas as the reducing agent, obviously any other hydrocarbon or solid carbon could be used for this purpose. The process is primarily applicable to the reduction of aluminum oxide to aluminum, but other metals such as magnesium can be produced from their oxides by my process.

THE REACTOR

Figure 1:
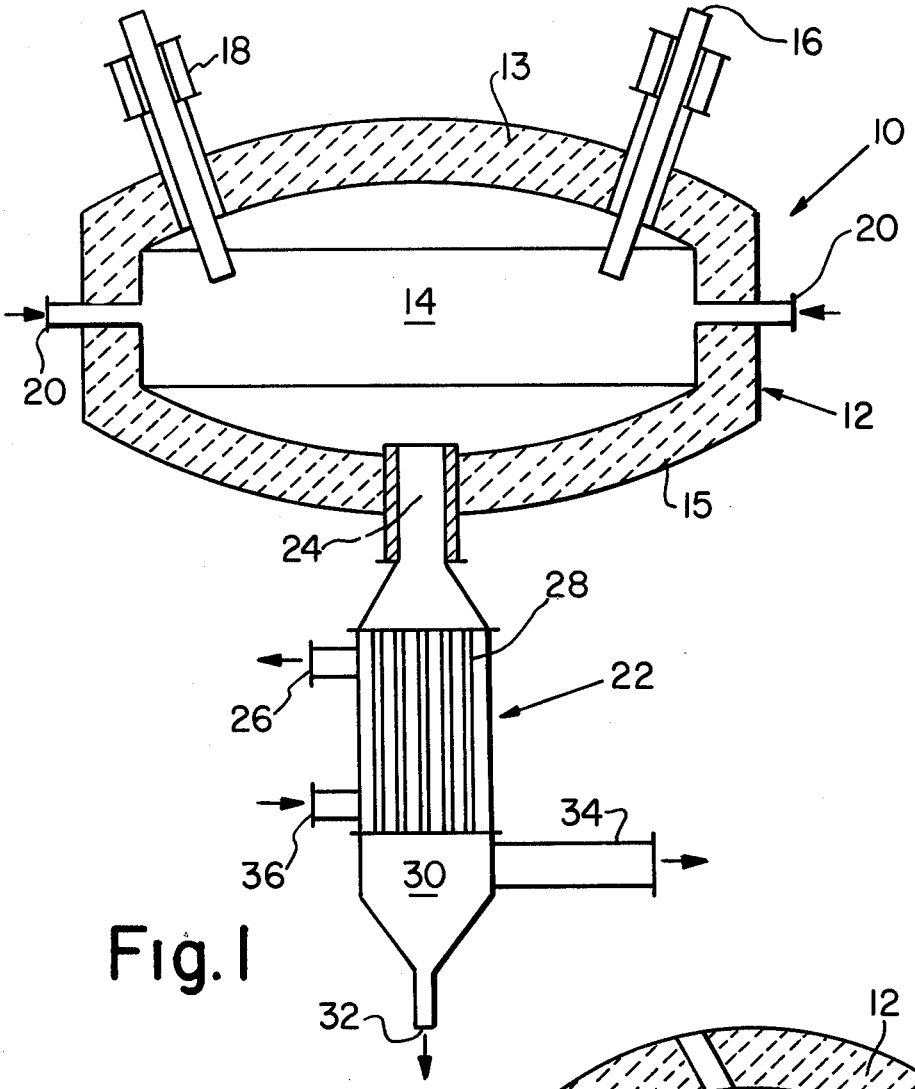
FIG. 1 is a vertical section of a reduction furnace for carrying out my process.
Figure 2:
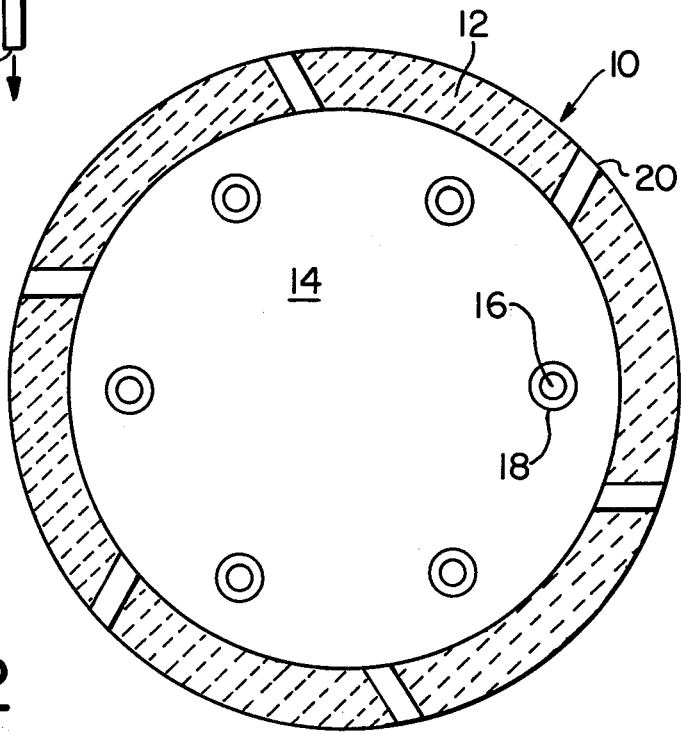
FIG. 2 is a horizontal section through the furnace of FIG. 1.

The reactor, generally designated 10, is schematically shown in FIGS. 1 and 2. A reaction chamber 14 wherein the reduction process takes place is defined by a cylindrical refractory wall 12, a dome-shaped refractory roof 13 and a dome-shaped refractory floor 15. The width of the reaction zone is substantially greater than its axial height as a matter of design preference.

A plurality of electrodes 16 (six illustrated in FIG. 2) extend through the roof 13 into the reaction zone 14 in spaced relationship. The electrodes 16, generally of carbon or graphite, are surrounded by appropriate insulation jackets 18. Also entering the reaction zone 14 through the wall 12 of the reactor 10 are input jet orifices 20. The jet orifices 20 are spaced about the wall 12 so each jet enters the reaction zone 14 substantially intermediate two adjacent electrodes 16. The jets 20 are positioned so that the entrants into the reaction zone through the jets have a moderate tangential velocity component.

An insulated exit duct 24 extends through the floor 15 along the vertical axis thereof. Exit duct 24 communicates the reaction zone 14 with a condenser 22. The condenser 22, generally of the surface condenser type, includes a plurality of heat transfer tubes 28 through which pass a cooling medium. The cooling medium enters through inlet 26 and exits through outlet 36. The lower portion of the condenser 22 constitutes a liquid metal-gas separator 30 having a liquid discharge 32 at the bottom thereof and a gas discharge 34 extending horizontally outward therefrom. Waste heat can be removed from condenser 22 by a heat transfer medium, like hydrogen or helium, and circulated in a closed loop.

THERMAL REDUCTION OF ALUMINUM OXIDE

Figure 3:
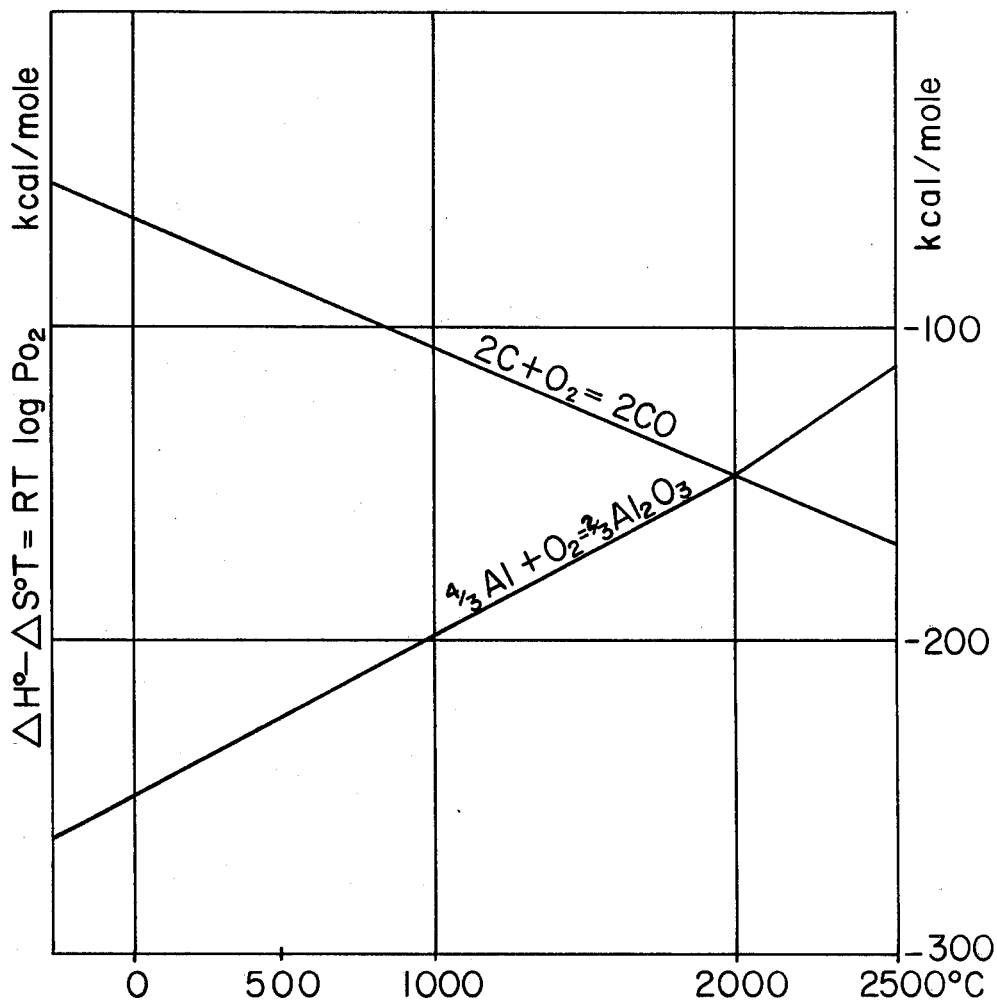
FIG. 3 is the oxygen potential diagram for aluminum oxide.

The conditions necessary for the thermal reduction of $Al_2O_3$ are shown in the oxygen potential diagram, FIG. 3. The lines representing the oxidation of Al to $Al_2O_3$ and of C to CO cross at 2000° C. Above this temperature, oxygen moves from the oxide to carbon, forming carbon monoxide. For high reaction rate and for decomposition of unwanted byproducts like $Al_2O$, AlO, $Al_4C_3$ and $Al_2OC$, the temperature in the reactor must exceed 2000° C. and preferably above 2200° C. In the following examples a gas temperature of 2400° C. is assumed in the high temperature zone of the reactor. At this temperature, aluminum is in vapor phase as shown by the following Table 1.

TABLE I

VAPOR PRESSURE OF ALUMINUM

| Temperature ° C | Pressure mm Hg | % Condensed from Initial 136 mm Hg Pressure |
|---|---|---|
| 2100 | 400 | 0 |
| 2000 | 190 | 0 |
| 1900 | 75 | 44 |
| 1800 | 30 | 77 |
| 1700 | 12 | 91 |
| 1600 | 4 | 97 |

The aluminum vapor leaves the reactor with the exit gases, and must be recovered by condensation.

The overall reaction is represented by the equation:

$$1Al_2O_3+3CH_4=2Al+3CO+6H_2$$

The reaction requires 20 cubic feet of natural gas per pound of aluminum produced and yields 60 cubic feet of carbon monoxide and hydrogen mixture as a by-product.

| | |
|---|---|
| Heat of reaction is at 298° K | 375.0 kcal/g mole of Al |
| Heat of content of the reaction products at 2700° K | 338.2 kcal/g mole of Al |
| Total heat requirement | 713.2 kcal/g mole of Al |

In large units the heat losses and compressor work are approximately compensated by preheating the feed material to about 300° C.

| | |
|---|---|
| The total electrical power requirement is therefore | 7.0 kwh/1 lb Al |
| Waste heat available from the aluminum condenser above 600° C is 294 kcal/g mole. With 35% conversion efficiency this amounts to | 1.0 kwh/1 lb Al |
| Net electric power requirement without utilization of the by-product gas is | 6.0 kwh/1 lb Al |
| Power generated from by-product gas with 35% efficiency amounts to | 1.85 kwh/1 lb Al |
| Net power requirement | 4.15 kwh/1 lb Al |

It may become more economical to utilize the by-product gas for the manufacture of liquid fuel or other chemical products. In this case the energy requirement of the process would be 6 kwh per pound of aluminum.

DISPERSED ELECTRIC DISCHARGE

Powerful electrical discharge currents are prevented from concentrating into narrow arc filaments by turbulent mixing if the following dispersion criterion is fulfilled:

$$\left(\frac{d N_e}{dT}\right)\left(\frac{1}{u'}\right)\frac{0.24\,\epsilon\, k_e}{\rho\, C_p}\times E^2 < 1$$

where $N_e$ is the number of electrons per $cm^3$
T is the gas temperature, °K.
u' is the intensity of turbulence, cm/sec
l/u' is the characteristic time of turbulence, sec
$\epsilon$ is the charge of the electron, $1.59.10^{19}$ coulomb
$\rho$ is the density of gas, $g/cm^3$
l is the scale of turbulence, cm
$k_e$ is the mobility of electrons (cm/sec)/(volt/cm)
$C_p$ is the heat capacity of gas, cal/g °C.
E is the voltage gradient, volt/cm The ionization potential of Al is low, only 5.984 volts. The ion-electron concentration of the product gas, consisting of 136 mm Hg Al, 200 mm Hg CO and 400 mm Hg $H_2$, due to thermal ionization of aluminum vapor is given below in Table 2 as a function of the gas temperature.

TABLE 2

ION-ELECTRON CONCENTRATION

In Product Gas Containing
136 mm Hg Al
200 mm Hg CO
400 mm Hg $H_2$

| Temperature ° K | $N_e$ 1/cm $^3$ | $\left(\frac{dN_e}{dT}\right)\frac{1}{cm^3\,°\,C}$ |
|---|---|---|
| 2300 | $0.34\times10^{13}$ | $0.29\times10^{11}$ |
| 2400 | $0.63\times10^{13}$ | $0.52\times10^{11}$ |
| 2500 | $1.5\times10^{13}$ | $0.8\times10^{11}$ |
| 2600 | $1.97\times10^{13}$ | $1.31\times10^{11}$ |
| 2700 | $3.28\times10^{13}$ | $2.0\times10^{11}$ |
| 2800 | $5.3\times10^{13}$ | $2.7\times10^{11}$ |
| 2900 | $8.0\times10^{13}$ | $4.2\times10^{11}$ |

Turbulence with a characteristic time of about $10^{-3}$ seconds or less is maintained by the gaseous jets entering the reactor. At this characteristic time of turbulence the critical voltage gradient for dispersion of the discharge is calculated to be 31.6 volts/cm at 2500° K. gas temperature. As shown below in the numerical example of a 30,000 kw reduction furnace the design value of the voltage gradient is only a fraction of this critical value. The design of the reduction furnace is governed by the desired residence time and not by the permissible voltage gradient.

The probability for concentration of the discharge current into an arc filament is further reduced by the heat absorbed by the reaction which stabilizes the temperature, and by continuous stretching of fluid lines by the vortex motion of the gases in the furnace.

In contrast to an arc the heat input of a dispersed discharge is spread out over the entire interior high temperature zone of the reactor. Consequently, no fraction of the feed material can pass through the furnace unreacted and contaminate the product stream.

THE REDUCTION PROCESS

A 30,000 kw reduction unit is used as an example for the description of the process. Aluminum oxide powder is carried by a stream of natural gas or recycled product gas and injected with a moderate tangential velocity component into the furnace 10. The gaseous jets entering into the furnace maintain strong turbulence in the medium. The turbulent motion keeps the solid particles in suspension and prevents the discharge currents from concentrating into arc filaments.

The dust laden gases circulate around the vertical axis of the furnace and move slowly inward. They are preheated in the outer zone of the furnace by heat radiated from the hot inner zone of the furnace. Natural gas, or other hydrocarbons, are decomposed in this preheat zone into hydrogen and fine carbon particles. The $Al_2O_3$ and carbon particles are retained in the furnace by the centrifugal force of the vortex motion until they are consumed by the reaction. Thus, while the residence time of the gases in the hot zone of the furnace is in the order of a second, the particles are retained for a much longer time, depending upon their size. The gaseous reaction products leave the furnace 10 through the central exit 24 and pass into condenser 22 where approximately 97% of the aluminum vapor is condensed while the temperature of the gas stream is reduced from 2000° C. to 1600° C. The condensed liquid aluminum is separated from the gas stream in liquid-gas separator 30 and discharged in a continuous stream of liquid metal. Waste heat is removed from the condenser 22 by a heat transfer medium, like hydrogen or helium, circulating in a closed loop. A substantial fraction of this waste heat may be reconverted into electrical power by a gas turbine.

The gas stream may pass through a second condenser (not shown) where the rest of the metal containing impurities is condensed. The gas stream leaving the condensers passes through a cooler and a cyclone separator, where the solid products of the back reaction, which are in the form of fine dust particles, are removed. These solids, consisting mainly of $Al_2O_3$, $Al_4C_3$ and $Al_2OC$ are recycled with the feed material into the reduction furnace. In the condenser 22 and in the separator 30, the high surface tension of molten aluminum prevents the fine oxide and carbide particles from entering into the molten metal.

Electric power, for example, in the form of three-phase 60 cycle a.c. is fed into the reduction furnace 10 through the carbon electrodes 16. The electric current may leave the electrodes 16 in the form of arc filaments which pass through the cooler outer zones and disperse from there in the form of a dispersed discharge into the hot reaction volume.

Thermal radiation originating from the hot reaction volume is intercepted by the clouds of $Al_2O_3$ and carbon particles carried by the gas in the outer regions of the furnace. Thereby, the walls of the furnace are protected from strong heat radiation and heat losses from the furnace are kept at a moderate level. Radiated heat absorbed by the particles is utilized for preheating the feed stream.

Experience with liquid sprays shows that coagulation of droplets remains insignificant as long as the volume of the gas in which the droplets are dispersed is more than 5,000 times the total volume of the liquid droplets. At the temperatures where the oxide particles begin to soften, the ratio of gas volume to the volume of solid particles is much larger than the above limit. Consequently, significant coagulation of the oxide particles in the furnace is not to be expected.

Aluminum production rate of a 30,000 kw reduction furnace would be, with 7 kwh energy input into the furnace per pound of Al, approximately 2 t/h or 16,000 t/year.

| | |
|---|---|
| Power from the waste heat recovery turbine | 4,300 kw |
| Power from exhaust gas powered turbine | 8,000 kw |
| Outside power supply | 17,700 kw |
| | 30,000 kw |

Assuming a residence time of one second for the gases in the high temperature reaction zone, the dimensions of the furnace are calculated to be:

| | | |
|---|---|---|
| Active volume | | 18 $m^3$ |
| Total volume | | 36 $m^3$ |
| Diameter | | 4.5 m = 15' |
| Height | | 2.25 m = 7.5' |
| Diameter of electrode circle | | 3.6 m |
| Electrode diameter (6 electrodes) | | 6" |
| Power input density | | 2 watts/$cm^3$ |
| Average voltage gradient | | 15 volts/cm |
| Phase voltage | | 2700 volts |
| Electrode current (6 electrodes) | | 1850 amps. |
| Line voltage | | 4700 volts |
| Line current | | 3700 amps |
| Furnace exit duct diameter | | 25 cm = 10" |
| Circumferential velocity at exit | | 100 m/sec |
| Circumferential velocity at the wall | | 6 m/sec |
| Centrifugal acceleration at the exit | | 10,000 g |
| Particles larger than 10μ diameter are retained by the centrifugal force. | | |
| Radiation loss through exit area | | 200 kw |
| Heat loss through the walls | | 300 kw |
| Condenser for Al vapor | | |
| | Inlet | Outlet |
| Temperature | 2,000° C | 1,6000° C |
| Pressure of Al vapor | 136 mm Hg | 4 mm Hg |
| Flow velocity | 600 m/sec | 400 m/sec |
| Diameter of condenser tubes | | 2.5 cm |
| Number of tubes | | 80 |
| Length of tubes | | 75 cm |
| Pressure drop | | 0.15 atm |
| Residence time in condenser tube | | $1.5.10^{-3}$ sec |
| Required compressor work | | 60 kw |

Below 2000° C., the reaction reverses and Al is oxidized by CO. The rate of this back reaction is not known. However, most of the metal is condensed in a fraction of the time required for the product gases to pass through the condenser tube, that is, in a fraction of a millisecond. The time element for reducing the temperature of the Al vapor is very important and should be as short as possible. The time required to reduce the temperature from 2000° C. to 1600° C. can be further shortened by using tubes of smaller diameter and length and allowing higher pressure drop in the condenser. The condenser may have other geometrical configuration to reduce the residence time in the critical temperature interval. For example, it may consist of a bundle of tubes or ribs over which the hot gas stream is passing.

The conditions for the existence of the dispersed electric discharge in the furnace may be established by heating the furnace and the gas stream by natural gas-oxygen flames or by electric arcs and evaporating some aluminum in the furnace. Once the discharge has been started the required ionization level is maintained by the long residence time of the recirculating hot gases.

The temperature in the reduction furnace at the exit therefrom is well above the decomposition temperature of aluminum carbide (2200° C.). Downstream of the furnace, aluminum and carbon are not in contact any more. Aluminum carbide formation is therefore not expected in the reduction process.

Particles of $Al_2O_3$ and carbon are retained in the furnace longer than the gases. The amount of carbon present could therefore at times deviate from the amount required to complete the reaction. Fine particles of excess carbon can be carried out from the furnace with the product gases. The characteristic radiation of carbon emitted from the exit gas may be used for the automatic control of the natural gas flow rate and the power input rate into the furnace. For example, as soon as radiation of carbon particles is detected, the $CH_4$ flow rate into the reactor is slightly reduced or some oxygen can be introduced into the reactor to burn the excess carbon to CO. This feedback control assures the purity of the product. The electric power input is controlled by the voltage impressed on the electrodes.

The thermal reduction process described above is a continuous process well suited for large capacity units and automatic controls. Liquid metal is collected at one point and discharged in a continuous stream. Power consumption of the process will be significantly lower than that of the best Hall Process plants, and comparable with the ultimately expected power consumption rate of the new chlorine process. Standard three-phase a.c. current can be used, saving the cost of conversion to d.c. power. Interruptible power supply is acceptable as no molten materials, except aluminum, are handled in bulk. Purity of the metal will be exceptionally high because no impurities are introduced with the reducing agent and the liquid metal is obtained by condensation. Electrode consumption will be minimal. The system is totally closed and has no harmful emissions. The production capacity of two or three reduction furnaces will equal that of the largest Hall Process pot lines. The area of reduction plants and the required capital investment will be substantially lower. The use of interruptible power, smaller plant, and absence of air pollution will allow greater freedom in the choice of plant location. This in turn can reduce the cost of transportation of alumina and ingot.

I claim:

1. A thermal reduction process for reducing metal oxides in a reactor comprising:

A. introducing the metal oxide in powder form and a reductant in a gaseous medium into a reaction zone of the reactor with a tangential component to create a vortex motion;

B. maintaining a dispersed electrical discharge in the reaction zone through a minimum turbulence level of the gaseous medium;

C. maintaining a temperature in the reaction zone above a reduction-reaction temperature of said oxide;

D. reducing said powder to metal vapor;

E. retaining said powder in the said reaction zone through centrifugal force until reduced;

F. removing an effluent stream of gases including the metal vapor from said reaction zone; and G. converting the metal vapor to the liquid state.

2. The process of claim 1, said metal oxide being aluminum oxide.

3. The process of claim 2, said temperature being maintained in excess of 2000° C.

4. The process of claim 2 including the step of establishing the dispersed discharge within the reactor zone in the presence of aluminum vapor.

5. The process of claim 2 wherein the converting step comprises condensing the aluminum vapor into the liquid state external of the reaction zone.

6. The process of claim 2 including the further step of monitoring the effluent stream for excessive reductant feed.

7. The process of claim 6 including controlling the flow rate of the reductant into like reaction zone in response to a signal that reductant is in the effluent stream.

8. The process of claim 6 including introducing oxygen into the reaction zone in response to a signal that reductant is in the effluent stream.

9. The process of claim 2 wherein the reductant is selected from the group consisting of natural gas, hydrocarbon gas other than natural gas and solid carbon.

10. The process of claim 5 wherein the condensing step includes passing the effluent stream through a condenser wherein the temperature of the stream is rapidly reduced to at least 1600° C.

11. The process of claim 10 wherein the effluent stream enters the condenser at a flow velocity of at least about 600 m/sec.

12. The process of claim 10 including separating the liquid aluminum from the effluent stream of gas in a liquid-gas separator and discharging a stream of liquid aluminum.

13. The process of claim 3 wherein said temperature in the reaction zone in the area of the effluent stream removal is maintained at about 2400° C.

14. The process of claim 4 including establishing said dispersed discharge between spaced electrodes by filling said space with aluminum vapor and ionizing said aluminum vapor.

15. The process of claim 2, said reductant comprising the gaseous medium.

16. The process of claim 2, said introducing step comprising introducing said oxide powder, reductant and gaseous medium through a plurality of spaced and aligned jets.

17. The process of claim 6 wherein a free carbon content of the effluent stream is monitored.

18. The process of claim 2 wherein the minimum turbulence level is defined by a characteristic time in the reaction zone on the order of $10^{-3}$ seconds or less.

19. A process for thermally reducing aluminum oxide powder to aluminum in a reactor comprising:

A. establishing a dispersed electric discharge within a reactor zone in the presence of aluminum vapor to maintain a temperature in a center portion of said zone of at least 2000° C.;

B. introducing aluminum oxide powder and natural gas as introductants into the reaction zone with a tangential component to create a vortex motion;

C. maintaining the dispersed discharge in the reaction zone through a minimum turbulence level of the introductants;

D. reducing said powder to aluminum vapor and retaining said powder in said reaction zone until reduced;

E. removing an effluent stream of gases including aluminum vapor from said reaction zone; and F. reducing the temperature of the effluent stream in a condenser rapidly to 1600° C. to condense the aluminum vapor to molten aluminum.

* * * * *